US007392600B2

(12) United States Patent
Gerlach et al.

(10) Patent No.: US 7,392,600 B2
(45) **Date of Patent: *Jul. 1, 2008**

(54) FABRIC ARTICLE TREATING METHOD USING ELECTRICALLY CHARGED LIQUID IN A CLOTHES DRYING APPLIANCE

(75) Inventors: Christian Gerhard Friedrich Gerlach, Brussels (BE); Bradford Scott Barron, Cincinnati, OH (US); Dean Larry DuVal, Lebanon, OH (US); Eugene Joseph Pancheri, Cincinnati, OH (US); Mary Jane Combs, Covington, KY (US); Paul Eugene Rienzo, Cincinnati, OH (US)

(73) Assignee: The Procter and Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/407,418

(22) Filed: Apr. 20, 2006

(65) Prior Publication Data

US 2006/0191157 A1 Aug. 31, 2006

Related U.S. Application Data

(63) Continuation of application No. 10/418,595, filed on Apr. 17, 2003, now Pat. No. 7,059,065.

(60) Provisional application No. 60/426,438, filed on Nov. 14, 2002, provisional application No. 60/374,601, filed on Apr. 22, 2002.

(51) Int. Cl.
*F26B 7/00* (2006.01)

(52) U.S. Cl. ..... 34/381

(58) Field of Classification Search ..... 34/381, 34/418

See application file for complete search history.

(56) References Cited

U.S. PATENT DOCUMENTS

| | | | |
|---|---|---|---|
| 2,079,280 | A | 5/1937 | Couch |
| 2,807,893 | A | 10/1957 | Morey |
| 2,812,593 | A | 11/1957 | Olthuis |
| 2,846,776 | A | 8/1958 | Clark |
| 2,851,791 | A | 9/1958 | Olthuis |
| 2,873,539 | A | 2/1959 | Morey |

(Continued)

FOREIGN PATENT DOCUMENTS

DE 23 18 596 B2 4/1980

(Continued)

OTHER PUBLICATIONS

U.S. Appl. No. 11/592,359, filed Nov. 3, 2006, Barron et al.

(Continued)

*Primary Examiner*—S. Gravini
(74) *Attorney, Agent, or Firm*—Julia A. Glazer; Brant Cook; Kim William Zerby

(57) ABSTRACT

A dispensing device for use in combination with a clothes dryer wherein the device is designed to uniformly treat fabric. The invention further relates to a method for treating a fabric article in need of treatment that combines a clothes dryer and liquid dispensing system designed to uniformly treat fabric.

8 Claims, 4 Drawing Sheets

U.S. PATENT DOCUMENTS 2,941,309 A 6/1960 Cobb
2,958,954 A 11/1960 Longenecker
3,002,288 A 10/1961 Conlee
3,022,580 A 2/1962 Doty
3,103,450 A 9/1963 Janson
3,114,653 A 12/1963 Kruzan
3,172,604 A 3/1965 Brock
3,180,037 A 4/1965 Kenreich et al.
3,239,947 A 3/1966 Kenreich et al.
3,267,701 A 8/1966 Mandarino
3,364,585 A 1/1968 Fish
3,583,180 A 6/1971 Arbogast
3,595,036 A 7/1971 Laddle
3,634,947 A 1/1972 Furgal
3,816,070 A 6/1974 Candor et al.
3,872,604 A 3/1975 Keller
4,009,598 A 3/1977 Bernard et al.
4,014,105 A 3/1977 Furgal et al.
4,022,938 A 5/1977 Zaki et al.
4,098,937 A 7/1978 Mizuno et al.
4,207,683 A 6/1980 Horton
4,236,320 A 12/1980 Schwadike et al.
4,242,377 A 12/1980 Roberts et al.
4,341,347 A 7/1982 DeVittorio
4,501,682 A 2/1985 Goodman et al.
4,511,495 A 4/1985 Melville
4,532,722 A 8/1985 Sax
4,567,675 A 2/1986 Rennie
4,579,279 A 4/1986 Marchant
4,618,099 A 10/1986 Nagao et al.
4,642,908 A 2/1987 Brenner
4,806,254 A 2/1989 Church
4,891,890 A 1/1990 Church
5,040,311 A 8/1991 Roy
5,234,610 A 8/1993 Gardlik et al.
5,438,773 A 8/1995 Chaffee
5,442,938 A 8/1995 Kislyuk
5,445,747 A 8/1995 Kvietok et al.
5,461,742 A 10/1995 Pasad et al.
5,595,071 A 1/1997 Pasad et al.
5,749,163 A 5/1998 Staub et al.
5,771,604 A 6/1998 Wunderlich et al.
5,789,368 A 8/1998 You et al.
5,810,265 A 9/1998 Cornelius et al.
5,884,418 A 3/1999 Mc Nally
5,912,408 A 6/1999 Trinh et al.
5,930,909 A 8/1999 Mc Nally
5,945,111 A 8/1999 Esser
5,965,517 A 10/1999 Mooney
5,966,831 A 10/1999 Anderson
5,968,404 A 10/1999 Trinh et al.
5,980,583 A * 11/1999 Staub et al. ..... 8/149.2
5,997,759 A 12/1999 Trinh et al.
6,001,343 A 12/1999 Trinh et al.
6,067,723 A 5/2000 Lafrenz
6,103,678 A 8/2000 Masschelein et al.
6,160,110 A 12/2000 Thomaides et al.
6,277,810 B2 8/2001 Baines et al.
6,279,834 B1 8/2001 Fox et al.
6,315,800 B1 11/2001 Gomes et al.
6,376,455 B1 4/2002 Friedi et al.
6,474,563 B2 * 11/2002 Pletcher et al. ..... 239/3
6,491,840 B1 12/2002 Frankenbach et al.
6,503,413 B2 1/2003 Uchiyama et al.
6,571,993 B2 6/2003 Rodd et al.
6,574,883 B2 6/2003 Giblin et al.
6,604,297 B2 8/2003 Hagemann et al.
6,609,311 B2 8/2003 Hagemann et al.
6,696,405 B2 2/2004 Mooney
6,792,695 B2 9/2004 Fry et al.
6,883,723 B2 4/2005 Griese et al.
6,889,399 B2 5/2005 Steiner et al.
7,059,065 B2 * 6/2006 Gerlach et al. ..... 34/381
2001/0036909 A1 11/2001 Levinson
2001/0044399 A1 11/2001 Keppie et al.
2001/0052551 A1 12/2001 Pletcher et al.
2001/0052552 A1 12/2001 Hamaguchi et al.
2002/0050073 A1 5/2002 Hagemann et al.
2002/0069465 A1 6/2002 Chute et al.
2002/0078589 A1 6/2002 Hagemann et al.
2002/0083615 A1 7/2002 Giblin et al.
2002/0100122 A1 8/2002 Rodrigues et al.
2002/0112293 A1 8/2002 Trinh et al.
2003/0035748 A1 2/2003 Trinh et al.
2003/0196348 A1 10/2003 Hagemann et al.
2003/0199416 A1 10/2003 Fry et al.
2003/0199417 A1 10/2003 Fry et al.
2003/0200674 A1 10/2003 Fry et al.
2003/0213145 A1 11/2003 Hagemann et al.
2003/0224965 A1 12/2003 Conley et al.
2004/0064970 A1 4/2004 Hagemann et al.
2004/0118014 A1 6/2004 Burgess et al.
2004/0123489 A1 7/2004 Pancheri et al.
2004/0123490 A1 7/2004 Pancheri et al.
2004/0134090 A1 7/2004 Heilman et al.
2004/0134094 A1 7/2004 Hahn et al.
2004/0143994 A1 7/2004 Barron et al.
2004/0221476 A1 11/2004 Jones et al.
2004/0253376 A1 12/2004 Parker
2004/0259750 A1 12/2004 DuVal et al.
2005/0020478 A1 1/2005 Cooke et al.
2005/0022311 A1 2/2005 Zhang et al.
2005/0076453 A1 4/2005 Lucas et al.
2005/0076532 A1 4/2005 Ward et al.
2005/0076533 A1 4/2005 Huston et al.
2005/0076534 A1 4/2005 Ofosu-Asante et al.
2005/0091879 A1 5/2005 DuVal et al.
2005/0120584 A1 6/2005 DuVal et al.
2005/0251924 A1 11/2005 DuVal et al.
2006/0080860 A1 4/2006 Clark et al.
2006/0123654 A1 6/2006 Zhang et al.
2006/0162180 A1 7/2006 Heilman et al.
2007/0000068 A1 1/2007 France et al.
2007/0000291 A1 1/2007 France et al.

FOREIGN PATENT DOCUMENTS

EP 0 130 682 1/1985
EP 0 118 313 5/1987
EP 0 315 879 B1 5/1989
EP 0 204 484 B1 3/1992
EP 0 594 154 A1 4/1994
EP 0 848 999 A2 6/1998
EP 0 676 497 B1 9/1999
EP 0 953 669 A2 11/1999
EP 1 479 757 A1 11/2004
GB 2 066 309 A 7/1981
GB 2 231 944 A 11/1990
GB 2 354 006 B 3/2001
GB 2 366 568 A 3/2002
GB 2 346 678 B 10/2002
JP 02-203976 A 8/1990
JP 02-302300 12/1990
JP 02-302300 A 12/1990
JP 06-015090 1/1994
JP 1995068094 A2 3/1995
JP 08-150293 6/1996
JP 1996215488 A 8/1996
JP 09-010488 A 1/1997
JP 09-267000 A 10/1997
JP 10-290898 A 11/1998
JP 2001-162099 6/2001
JP 2002069832 A2 3/2002
JP 2002115182 A 4/2002

| | | | |
|---|---|---|---|
| WO | WO 96/09430 | | 3/1996 |
| WO | WO 99/55952 | A1 | 11/1999 |
| WO | WO 99/55953 | A1 | 11/1999 |
| WO | WO 00/01421 | A1 | 1/2000 |
| WO | WO 00/01422 | A1 | 1/2000 |
| WO | WO 00/01493 | A1 | 1/2000 |
| WO | WO 00/11133 | | 3/2000 |
| WO | WO 00/24851 | A2 | 5/2000 |
| WO | WO 00/24856 | A1 | 5/2000 |
| WO | WO 00/24858 | A1 | 5/2000 |
| WO | WO 00/38512 | A1 | 7/2000 |
| WO | WO 00/55292 | | 9/2000 |
| WO | WO 00/58428 | | 10/2000 |
| WO | WO 01/07710 | A1 | 2/2001 |
| WO | WO 01/18145 | A2 | 3/2001 |
| WO | WO 01/66264 | A1 | 9/2001 |
| WO | WO 02/08510 | A1 | 1/2002 |
| WO | WO 01/12423 | A2 | 2/2002 |
| WO | WO 02/33161 | A1 | 4/2002 |
| WO | WO 02/40623 | A2 | 5/2002 |
| WO | WO 03/004170 | A1 | 1/2003 |
| WO | WO 03/008528 | A1 | 1/2003 |
| WO | WO 03/087286 | A1 | 10/2003 |
| WO | WO 03/087461 | A1 | 10/2003 |
| WO | WO 03/102289 | A1 | 12/2003 |
| WO | WO 2004/099489 | A2 | 11/2004 |

OTHER PUBLICATIONS

International Critical Tables of Numerical Data, Physics, Chemistry and Technology, National Research Council of the United States of America, Edward W. Washburn, editor in chief, first electronic edition, published by Knovel, Norwich, New York, 2003, pp. 148-162.

Handbook of Chemistry and Physics, 3rd electronic edition, following the 81st printed edition, David R. Lide, editor-in-chief, published by CRC Press, Inc. 2000, Boca Raton, Florida, pp. 5-102 to 5-103, 5-4 to 5-88.

Perry's Chemical Engineer's Handbook, seventh edition, following the 81st printed edition, published by McGraw-Hill, ISBN 0-07-049841-5, 1997, pp. 2-187 to 2-195.

Brokaw, Leslie—"Get a Whiff Of This", Inc.com Magazine, Nov. 1988, (1 page) Copyright 2003 Gruner + Jahr USA Publishing, Inc. com, 77 North Washington Street, Boston, MA 02114.

StainsFile—"Classification of Dyes"; "Basic Dyes"; "Direct Dyes"; "Acid Dyes"; Comparison of Dye Structure; "Structure and Colour in Dyes"; (16 pages). Internet Website http://members.pgonline.com/~bryand/StainsFile/dyes/class/dyeclass.htm, Nov. 2002.

Innovative Packaging Network—"Clean-Clic®" (1 page). Internet Website www.ipneurope.com/Componentright1.html.

Medlin, Jennifer—"Microban, Germ Warfare", Environmental Health Perspectives v.105, n.3, Mar97 (5 pages). Internet Website www.mindfully.org/Plastic/Microban-Germ-Warfare.htm.

Exair-Mail Newsletter—Winter 2002-03 (2 pages). Exair Corporation, 1250 Century Circle North, Cincinnati, Ohio, 45246-3309.

Fyffe, Matt—Technical Report—"Recent Developments in Long-Range Static Elimination", Jun. 2003 (3 pages). Meech Static Eliminators, USA, Richfield, Ohio, Internet Website www.meech.com.

Quantum Research Group "Capacitance Explained" printed Nov. 18, 2004 (3 pages). Internet Website www.qprox.com/background/capacitance.php.

* cited by examiner

FABRIC ARTICLE TREATING METHOD USING ELECTRICALLY CHARGED LIQUID IN A CLOTHES DRYING APPLIANCE

CROSS REFERENCE TO RELATED APPLICATIONS

This application is a Continuation of U.S. application Ser. No. 10/418,595, filed Apr. 17, 2003 now U.S. Pat. No. 7,059,065, which claims the benefit of U.S. Provisional Application Ser. No. 60/374,601, filed Apr. 22, 2002; and U.S. Provisional Application Ser. No. 60/426,438, filed Nov. 14, 2002.

FIELD OF THE INVENTION

The present invention relates to an in-home method for treating a fabric article in need of treatment and a new to the world, in-home fabric article treating system, particularly designed for domestic use, wherein the system comprises 1) a clothes drying appliance, and 2) a source of an electrically charged liquid, useful in such method. More particularly, the present invention relates to an in-home method for treating a fabric article that employs an electrically charged liquid to drive deposition of the liquid onto the fabric article to be treated.

BACKGROUND OF THE INVENTION

Fabric article treating methods and/or apparatuses have been evolving over the past 20 years. For example, U.S. Pat. No. 4,207,683 describes a conventional automatic clothes dryer that incorporates a spray dispenser capable of dispensing liquids into the drum of the dryer. U.S. Pat. Nos. 4,642,908, 5,771,604 and 6,067,723 describe other variations of conventional clothes drying appliances.

There exists an on-going need to develop a fabric article treating method and/or apparatus, especially an in-home fabric article treating method and/or apparatus that improves/enhances the deposition of fabric article actives onto fabric articles being treated as compared to the currently existing deposition methods and/or apparatuses.

SUMMARY OF THE INVENTION

The needs identified above are met by the present invention which provides an in-home method for treating a fabric article in need of treatment and a new to the world, in-home fabric article treating system, particularly designed for domestic use, wherein the system comprises 1) a clothes drying appliance, and 2) a source of an electrically charged liquid for use within the method.

In one aspect of the present invention, an in-home method for treating a fabric article in need of treatment comprising:

a. providing a new to the world, in-home, fabric article treating system, particularly designed for domestic use, wherein the system comprises 1) a clothes drying appliance, and 2) a source of an electrically charged liquid, and optionally, 3) a safety system capable of preventing contact of the electrically charged liquid to a user of the clothes drying appliance;

b. positioning the fabric article in need of treatment within the clothes drying appliance;

c. operating the fabric article treating system such that the source of the electrically charged liquid delivers an electrically charged liquid to the fabric article placed within the clothes drying appliance such that the fabric article is treated, is provided.

In another aspect of the present invention, a new to the world, fabric article treating system designed for domestic use, wherein the system comprises 1) a clothes drying appliance, and 2) a source of an electrically charged liquid, and optionally, 3) a safety system capable of preventing contact of the electrically charged liquid to a user of the fabric article treating system, is provided.

In even another aspect of the present invention, an article of manufacture comprising:

a. a composition comprising a moiety capable of acquiring an electric charge; and b. instructions for using the composition in a clothes drying appliance such that the moiety acquires an electric charge and retains the electric charge for a time period sufficient for the composition to contact a fabric article being treated within the clothes drying appliance, is provided.

In yet another aspect of the present invention, a fabric article treated by the method of the present invention, is provided.

In still yet another aspect of the present invention, a method for the treatment of a fabric article with a refreshing, deodorizing and/or finishing composition comprising at least one of the steps of:

(a) identifying an apparel characteristic of said fabric article;

(b) identifying a desired benefit for said fabric article; and (c) identifying at least one refreshing, deodorizing and/or finishing compositions appropriate for the apparel characteristic identified in (a) and/or the finish identified in (b) of said fabric article, wherein the compositions comprise a moiety capable of acquiring an electric charge; and (d) contacting said fabric article with an effective amount of an identified refreshing, deodorizing and/or finishing composition from (c), wherein the moiety within the composition possesses an electric charge for a time period sufficient for the composition to contact the fabric article, is provided.

To facilitate identifying a desired benefit for said fabric article in the method of the present invention, the fabric article may be associated with a fabric article care label comprising a non-verbal visual cue, which assists in versioning said fabric article in preparation for a treatment to obtain a desired benefit on the fabric article, is provided.

In even still yet another aspect of the present invention, an article of manufacture for delivering a desired benefit to a fabric article in a clothes drying appliance comprising:

(a) a container comprising a benefit composition for delivering a desired benefit to a fabric article, wherein said benefit composition comprises:

(i) a moiety capable of acquiring an electric charge;

(ii) an effective amount of a desired benefit agent;

(iii) optionally, a carrier;

(iv) optionally, an effective amount to absorb or reduce malodor, of an odor control agent; and (v) optionally, additional fabric care agents;

wherein said composition has a pH of from about 2 to about 11 and a viscosity of less than about 10,000 cps and/or a surface tension of less than about 100 dynes/cm;

(b) a set of instructions in association with said container comprising instructions to identify the apparel characteristic of said fabric article and/or desired benefit to be delivered to said fabric article, then to treat said fabric article with the benefit composition such that the moiety capable of acquiring an electric charge acquires and retains an electric charge for a time period sufficient for the benefit composition to contact the fabric article being treated, is provided.

In still yet another aspect of the present invention, an article of manufacture for delivering a desired benefit to a fabric article in a clothes drying appliance comprising:

(a) two or more containers comprising one or more separate, discrete benefit compositions for delivering one or more desired benefits to a fabric article, wherein said one or more separate, discrete benefit compositions comprises:
   (i) a moiety capable of acquiring an electric charge;
   (ii) an effective amount of a desired benefit agent;
   (iii) optionally, a carrier;
   (iv) optionally, an effective amount to absorb or reduce malodor, of an odor control agent; and
   (v) optionally, additional fabric care agents;
   wherein said composition has a pH of from about 2 to about 11 and a viscosity of less than about 10,000 cps and/or a surface tension of less than about 100 dynes/cm;

(b) a set of instructions in association with said container comprising instructions to identify the apparel characteristic of said fabric article and/or desired benefit to be delivered to said fabric article, then to treat said fabric article with said one or more separate, discrete benefit compositions such that the moiety capable of acquiring an electric charge acquires and retains an electric charge for a time period sufficient for said one or more separate, discrete benefit compositions to contact the fabric article being treated, is provided.

All percentages, ratios and proportions herein are on a weight basis unless otherwise indicated.

DETAILED DESCRIPTION OF THE INVENTION

Definitions

Figure 1:
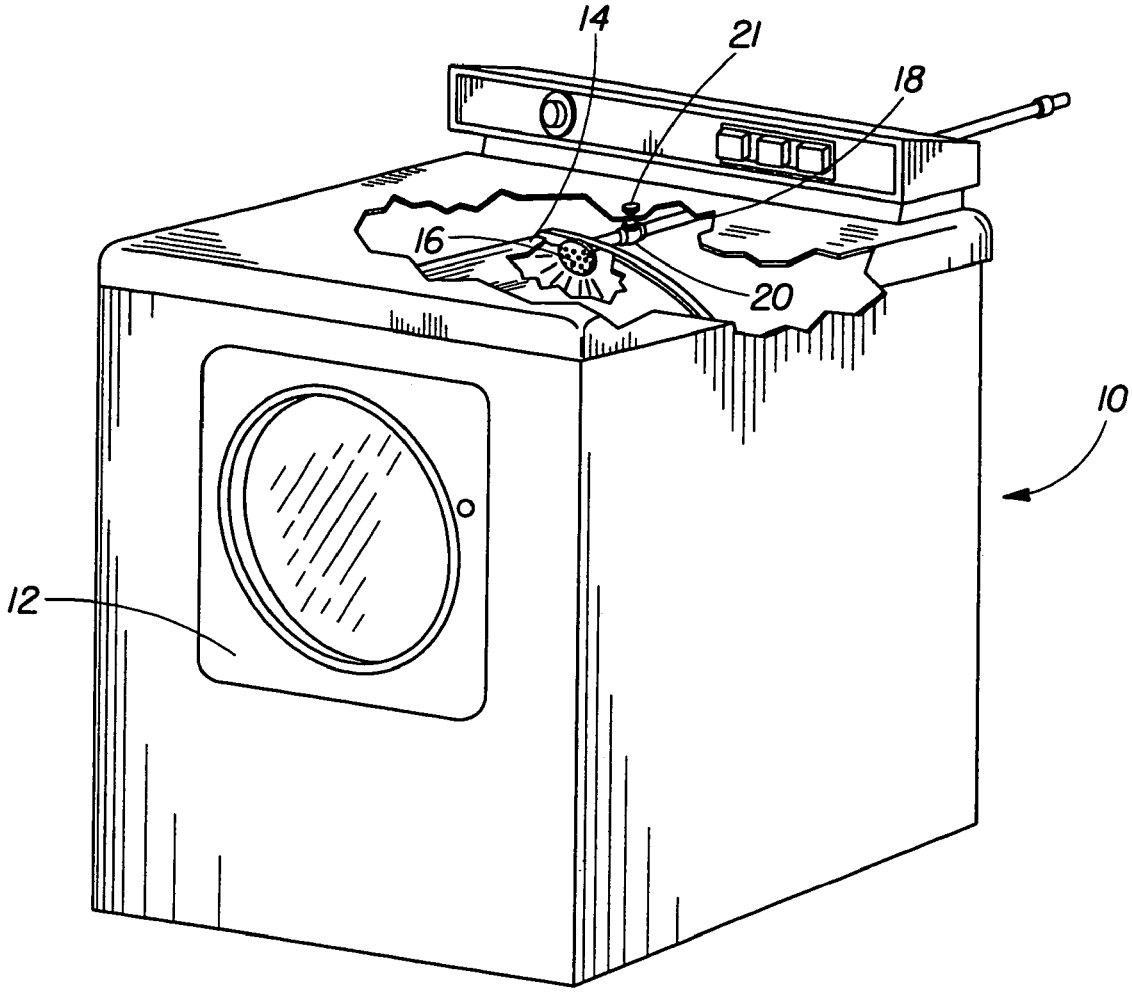
FIG. 1 is a perspective view of a new to the world, fabric article treating system in accordance with one embodiment of the present invention.

The phrase "new to the world, fabric article treating system" as used herein means a clothes (fabric article) drying appliance, that may be a conventional clothes dryers or a modification thereof, wherein the clothes (fabric articles) are moved (are in motion at least once) during the drying process.

"Fabric article" as used herein means any article that is customarily cleaned in a conventional laundry process or in a dry cleaning process. The term encompasses articles of clothing, linen and drapery, clothing accessories, floor coverings, and the like. The term also encompasses other items made in whole or in part of fabric, examples of which include but are not limited to tote bags, furniture covers, tarpaulins and the like.

"Refreshing" as used herein means cleaning, dewrinkling, finishing, and/or deodorizing fabric articles.

"Versioning" as used herein means a method for identifying the apparel characteristics of any particular garment, using those apparel characteristics to determine the desired finishing benefits most appropriate for that garment, and then selecting one or more compositions for use with the present invention to impart the most appropriate or desired finishing benefits on that garment.

Versioning is based on the type of fabric/material, (i.e. wool, cotton, silk, type of weave of material, knit, herringbone, oxford, broadcloth, and the construction of the garment). The combination of these three characteristics allow for a consumer to readily determine, by versioning, the apparel characteristics of any garment. Similarly, how apparel characteristics are identified by versioning will be illustrated in greater detail herein after.

"Crisp" refers to an apparel characteristic that is identified by versioning. It defines a garment, which has its own shape and body. A crisp garment tends to resist draping and movement while being worn. Dress business shirts are a good example of a predominately, or totally crisp garment.

"Flow" refers to an apparel characteristic that is identified by versioning. It defines a garment that lacks shape and body. A flow garment readily drapes and is unresistant to movement. Kaftans or mumus are non-limiting examples of garments that are predominately or totally flow garments.

"Stretch" refers to an apparel characteristic that is identified by versioning. It defines a garment that conforms to the body. A stretch garment contacts and stretches over the consumer's body. A stretch garment stretches and springs back under movement. Bicycle shorts, bating suits, tights, body hugging dresses and stirrup pants are non-limiting examples of garments that are predominately or totally stretch garments.

"Crisp Finish" refers to a finish that is designed to give fabric a defined shape that resists gravity, movement, or conformation to the body. This finish, which is usually applied to business related garments such as men's white cotton dress shirts, gives the impression of being freshly ironed. In essence, this finish provides a defined garment silhouette, and is most appropriate for crisp garments.

"Soft Finish" refers to a finish that enhances the feel and visional aesthetics of the garment, giving the overall impression of comfort to the garment. For stretch garments, such as lycra blends or knits, soft fabric feel can enhance the fabrics ability to conform and move with the body as well as making fabric to skin contact more comfortable. It also helps provide a revealing silhouette of the body. For flow-type garments, such as silk blouses or rayon dresses, a soft fabric feel can enhance the fabric draping and sliding-over-the-skin characteristics. It also helps provide an undefined silhouette of the body. This finish is most appropriate for flow or stretch garments. This treatment is also acceptable on structured garments such as suits where the structure of the garment provides a defined silhouette, but where flow or stretch characteristics are desired in the fit, or fabric to body contact.

A non-limiting list of desired finishing benefits may include one or more of the following; softening, crispness, water and/or stain repellency, refreshing, antistatic, anti-shrinkage, anti-microbial, durable press, wrinkle resistance, odor resistance, abrasion resistance, anti-felting, anti-pilling, appearance enhancement and mixtures thereof.

An "effective amount" as used herein means an amount of an ingredient/component needed to provide a human sensory (sight, touch, smell, taste, hearing) benefit to a fabric article.

Electrically Charged Liquid

"Electrically charged liquid" as used herein means any liquid, typically aqueous liquid, that has an applied potential in the range of from about 0.2 to about 50 kV and/or from about 0.5 to about 30 kV and/or from about 0.5 to about 25 kV. The liquid may have a negative charge potential, a positive charge potential, or a charge potential which oscillates therebetween. The electrically charged liquid may contain a moiety capable of acquiring an electric charge and optionally, capable of retaining an electric charge for a time period sufficient for the electrically charged liquid to contact a fabric article being treated by the electrically charged liquid.

"Source of electrically charged liquid" as used herein means any device or component associated with the new to the world, in-home, self-contained, stand alone fabric article treating apparatus that is capable of delivering an electrically charged liquid to an inanimate surface present in the apparatus such as a fabric article in need of treatment present in the apparatus. The source of electrically charged liquid may be a self-contained stand-alone device or it may be a component or subassembly of the drying appliance. The device may be removably attachable from the drying appliance.

The liquid may be electrically charged at any point in time prior to contacting the fabric article. Preferably it is electrically charged prior to the time it is separated from the source of the electrically charged liquid, but it may be electrically charged after it is separated from the source. Alternatively, the liquid could be electrically charged both prior to the time it is separated from the source of the electrically charged liquid and after it is separated from the source.

The source of electrically charged liquid may comprise an electrical charging component, typically an electrical field, that electrically charges the liquid and/or a moiety present in the liquid that is capable of acquiring an electric charge and optionally, capable of retaining an electric charge for a time period sufficient for the electrically charged liquid to contact a fabric article being treated. The source may also, and typically does, comprise a reservoir for containing the liquid to be electrically charged and/or the electrically charged liquid. In one embodiment, the electrical charging component is integral with the reservoir. In another embodiment, the electrical charging component is separate and discrete from the reservoir.

Further, the source may also, and typically does, comprise a nozzle through which the liquid to be charged or the electrically charged liquid passes during delivery to the fabric article. In one embodiment, the electrical charging component is integral with the nozzle. In another embodiment, the electrical charging component is separate and discrete from the nozzle.

Further yet, the source may comprise an adjusting component capable of controlling the orientation and/or direction of the dispensing electrically charged liquid from the nozzle.

Still further yet, the source may comprise a shaping component capable of electrically shaping the liquid dispensing from the nozzle. The shaping component may comprise an insulating element whereby in use the first droplets to contact the insulating element generate an electrostatic field for shaping the delivery of the electrically charged liquid and/or a conductive element whereby in use the conductive element is charged so as to generate an electrostatic field for shaping the delivery of the electrically charged liquid.

The source of electrically charged liquid may be grounded by way of being in contact with a grounded part of the clothes drying appliance such as by a spring, patch, magnet, screw, or other attaching means, and/or by way of dissipating residual charge. One way of dissipating the charge is by using an ionizing feature, for example a set of metallic wires extending away from the source.

Typically, the liquid dispensed from the nozzle 16, is either electrically charged prior to dispensing, after dispensing, or both. The liquid is delivered to the nozzle 16 by any suitable means, a nonlimiting example of such is hydraulic pressure using a suitable pump, such as a peristaltic pump 44. Generally, a suitable pump will have an operating pressure in the range of from about 1 to about 2,000 kPas, although pressures between 5 and 1500 kPas, and/or from about 10 to about 1050 kPas and/or from about 100 to 500 kPas can be used.

Generally, the electrically charged liquid is a conductive aqueous liquid. It is desirable that the liquid have a resistivity of less than about $10^5$ Ohms*m and/or less than about $10^4$ Ohms*m and/or less than about $10^3$ Ohms*m and/or less than about $10^2$ Ohms*m. However, a higher resistivity liquid can also be effectively delivered using the methods and apparatuses of the present invention.

The electrically charged liquid of the present invention may comprise water and/or some other solvent or liquid vehicle so long as the liquid is capable of being electrically charged and thus, carrying a potential.

The electrically charged liquid may comprise one or more fabric article actives. The electrically charged liquid comprising one or more fabric article actives is also referred to herein as a refreshment composition (which includes cleaning, dewrinkling, finishing, and/or deodorizing compositions, and the like). Non-limiting examples of fabric article actives include solvents, surfactants, wrinkle releasing agents, anti-static agents, anti-shrinking agents, antimicrobial agents, wetting agents, crystal modifiers, soil release agents, softening agents, colorants, brighteners, perfume, odor reducers/eliminators, deodorizer/refresher, stain repellents, color enhancers, starch, and sizing agents.

The refreshment composition may comprise water. In addition to water, the refreshment composition may also include non-volatile mineral agents, nonlimiting examples of which include water hardness agents, sodium chloride, sodium sulfate, sodium phosphate, calcium chloride, calcium sulfate, calcium phosphate, magnesium chloride, magnesium sulfate, magnesium phosphate, potassium chloride, potassium sulfate, potassium phosphate. Non-volatile mineral agents may be present in the refreshment composition at a level of from about 0 ppm to about 10,000 ppm and/or up to about 1000 ppm and/or up to about 100 ppm and/or up to about 50 ppm and/or up to about 25 ppm and/or up to about 10 ppm by weight of the refreshment composition. The refreshment composition may also include volatile mineral agents. A non-limiting list of volatile mineral agents includes ammonium carbonate, ammonium bicarbonate, ammonium carbamate, halide carbonates or bicarbonates in acid solutions, ammonium compounds in alkaline solutions, and the like. Volatile mineral agents may be present in the refreshment composition at a level of from about 0 ppm to about 10,000 ppm and/or up to about 1000 ppm and/or up to about 100 ppm and/or up to about 50 ppm and/or up to about 25 ppm and/or up to about 10 ppm by weight of the refreshment composition. Other fabric article actives may also be included along with the water in the refreshment composition. Examples of these other fabric article actives include but are not limited to surfactants, perfumes, preservatives, bleaches, auxiliary cleaning agents, anti-shrinking agents, organic solvents, anti-wrinkling agents, softening agents, antibacterial agents, wetting agents, crystal modifiers, and/or mixtures thereof. These other fabric article actives may be present in the refreshment composition at a level of from about 0.01% to about 99% by weight of the refreshment composition.

Typical fabric refreshment compositions herein can comprise at least about 80%, by weight of water, preferably at least about 90%, and more preferably at least about 95% water.

A more detailed description of the individual components of the refreshment compositions, that is, the organic solvents, surfactants, perfumes, preservatives, bleaches and auxiliary cleaning agents can be found in U.S. Pat. No. 5,789,368, issued on Aug. 4, 1998 to You et al. the entire disclosure of the You et al. application is incorporated herein by reference. Additionally, refreshment compositions are described in co-pending U.S. patent application Ser. No. 08/789,171, which was filed on Jan. 24, 1997, in the name of Trinh et al. The entire disclosure of the Trinh et al. application is incorporated herein by reference. Anti-shrinking agents suitable for use in this invention can be found in co-pending U.S. Provisional Application No. 60/097,596, entitled "Cleaning Compositions that Reduce Fabric Shrinkage", which was filed by Strang and Siklosi, on Aug. 24, 1998. The entire disclosure of the Strang and Siklosi application is incorporated herein by reference.

One unique challenge of spraying chemistries on clothes in the dryer is the propensity of current market formulations to plug spray nozzles in between uses. Several approaches can be used to prevent this plugging, including but not limited to; using some type of filtering mechanism, using single phase solutions, including higher levels of humectants or other moisture retaining ingredients, hydrophilic solvents, using film softening ingredients with polymers, and including hygroscopic salts in the formulas.

In-Home Fabric Article Treating System

The fabric article treating system of the present invention may include a housing, preferably a rigid housing that defines a fabric article receiving volume, which can be the drum of the clothes drying appliance, in which the fabric article is treated.

The fabric article treating system comprises a source of an electrically charged liquid; and optionally, a safety system capable of preventing contact of the electrically charged liquid to a user of the fabric article treating system.

Figure 2:
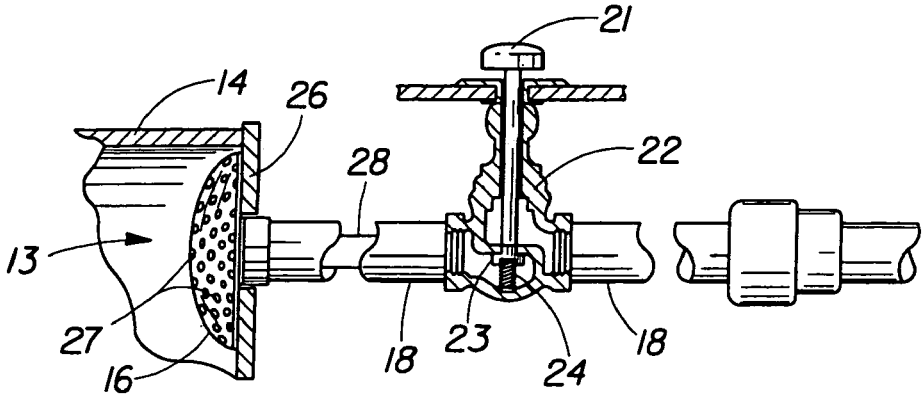
FIG. 2 is a sectional side view of the new to the world, fabric article treating system of FIG. 1.

Referring to FIGS. 1 and 2, there is illustrated a fabric article treating system for refreshing fabric articles according to the present invention. In one embodiment, the fabric article treating system can comprise a clothes drying appliance 10, as illustrated in FIG. 1. A door 12 can be movably connected to the clothes drying appliance 10 for ensuring that the fabric articles to be treated remain within the fabric article receiving volume 13 as shown in FIG. 2 or in other words, within the drum 14. A source of an electrically charged liquid, in one embodiment in the form of a nozzle 16, preferably a fluid atomizing nozzle and/or even a simple orifice through which the electrically charged liquid and/or liquid to be electrically charged can pass, is associated with the fabric article treating system.

The nozzle 16 can be fluidly connected via a liquid supply pipe 18 to a reservoir (not shown) containing a liquid to be electrically charged. In one embodiment, the reservoir can be a water line. In another embodiment, the reservoir may be a refillable and/or non-refillable container that has a finite amount of liquid contained therein. In even another embodiment, the reservoir may be both a water line and a refillable and/or non-refillable container that has a finite amount of liquid contained therein. The reservoir may be a disposable container. The reservoir may be fixedly attached to the drying appliance or it may be removably attached.

The fluid atomizing nozzle can be operated using compressed air to siphon the liquid from the reservoir and atomize it as it leaves the nozzle. The liquid could also be forced through the atomizing nozzle using a positive displacement liquid pump. Other types of pumps may be used as well such as but not limited to diaphragm and centrifugal pumps. Other suitable means for moving the liquid through the atomizing nozzle include but are not limited utilization of capillary action, propellants, syringes, and gas (both pre-pressurized and/or generated via in situ pressure).

A control valve 20 can be associated with the nozzle 16 to control the level of liquid passing through the nozzle 16. Valve 20, may be a gate valve, globe valve, plug valve, or any other valve suited for the purpose. One suitable valve, as shown in FIG. 2, is a spring loaded button controlled valve which permits a desired volume of liquid to be discharged through nozzle 16 very rapidly. Referring to FIGS. 1 and 2, valve 20 may be provided with a push button 21 extending through valve housing 22 and controlling a disk 23 forced into a closed position by compression spring 24. Depression of button 21 displaces disk 23 downwardly allowing liquid flow through the valve and hence through nozzle 16.

As shown in FIG. 2, nozzle 16 can be seated tightly against backwall 26 of the drum 14 of the clothes drying appliance 10 to prevent obstruction with fabric articles within the clothes drying appliance, especially when the fabric articles are in motion. Nozzle 16 can be disc-shaped having a convex forwardly facing surface. The convex surface can be provided with a multiplicity of narrow apertures 27 so that liquid forced through the nozzle, under pressure, produces a fine mist for contacting the fabric articles. If desired, an electrical charge can be created in the liquid prior to the liquid passing out of the nozzle 16, such as is shown by the placement of the electrical charging component 28 in the liquid supply pipe 18. Alternatively, an electrical charge can be added to the liquid after passing through the nozzle 16.

A fan can be provided for circulating air within the fabric article receiving volume 13 such that the mist form of the electrically charged liquid is distributed more evenly onto the fabric article within the fabric article receiving volume 13. However, air circulation during spraying is not essential (but possible) when the electrically charged liquid is in the form of large droplets. The trajectory of such electrically charged liquid droplets is determined by electrostatic attraction. Accordingly, the fabric article treating system of the present invention provides a means for applying an electrically charged liquid onto a fabric article in need of treatment which does not include means for supplying steam into the fabric article receiving volume 13.

The contact of the electrically charged liquid to the fabric article to be treated occurs within the fabric article receiving volume 13 of the fabric article treating system. In one embodiment, the contact may occur while the fabric articles are in motion. In another embodiment, the contact may occur while the fabric articles are not in motion. In even another embodiment, the contact may occur while the fabric articles are in motion and not in motion. The number of fabric articles present in the fabric article receiving volume may impact the uniformity of the deposition of the actives from the electrically charged liquid. The number of fabric articles depends upon their respective sizes and type. For example, twelve or less and/or eight or less and/or five or less and/or 3 or less fabric articles may be treated concurrently.

The fabric article treating system may comprise a grounding component, such as a metal plate, that the fabric article is releasably associated with such that the fabric article is draped around the grounding component thus facilitating deposition from the nozzle to the fabric article of the electrically charged liquid, and thus any fabric article actives contained in the electrically charged liquid as it passes through and/or deposits onto the fabric article.

Figure 3:
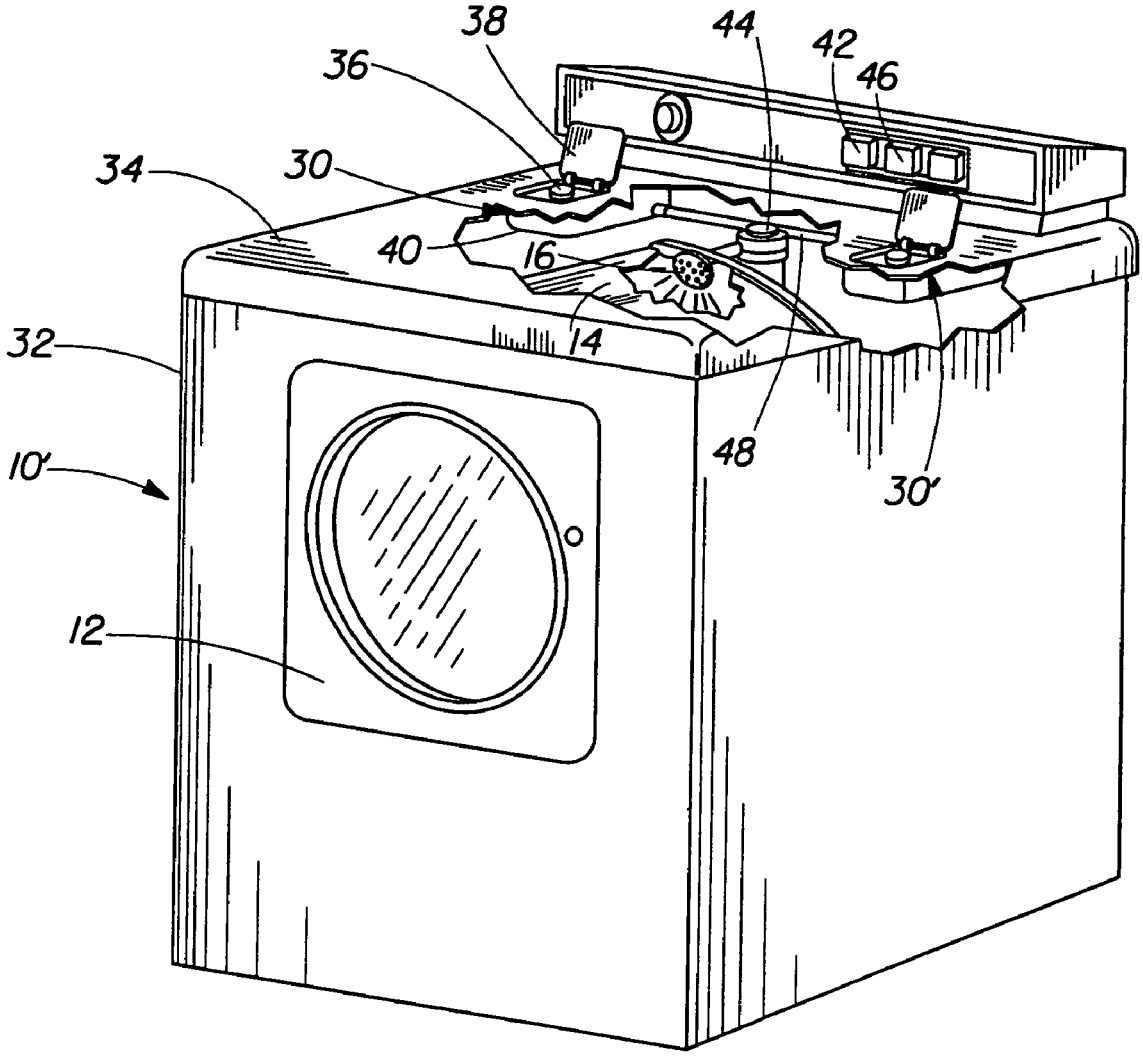
FIG. 3 is a perspective view of a new to the world, fabric article treating system in accordance with another embodiment of the present invention.

Referring now to FIG. 3, in another embodiment of a fabric article treating system in accordance with the present invention, the fabric article treating system may comprise a clothes drying appliance 10'. The clothes drying appliance 10' may comprise a self-contained electrically charged liquid reservoir 30 which can be mounted to external housing 32 of the clothes drying appliance 10', typically adjacent the top surface 34 of the clothes drying appliance 10' for convenient filling, but can be located elsewhere. The reservoir 30 can be permanently fixed to the clothes drying appliance 10' or can be releasably fixed to the clothes drying appliance 10'. Reservoir 30 may be provided with a screw cap 36 threaded into the top of the reservoir to provide access for filling the reservoir. A cover lid 38, hingeably engaging top surface 34 of the clothes drying appliance 10', may also be provided to enhance the appearance of the clothes drying appliance and to provide a level working surface on the clothes drying appliance top.

Reservoir 30 may be further equipped with a heating element, as for example heating coil 40, and a suitable thermostat to provide electrically charged liquid of a selected temperature for spraying. On-Off switch 42 is operable to control flow of electricity to the heating coil as is indicated by the dotted line therebetween. In a gas dryer, reservoir 30 may be heated by a gas burner, either separate or in combination with the primary burner of the dryer. Electrically charged liquid held in reservoir 30 may be discharged directly through spray nozzle 16 and controlled by a suitable valve; one such suitable valve being shown in FIG. 2; or, as preferred, may be discharged through the nozzle by means of a motor and pump unit, designated generally by the numeral 44, for superior spray action. The motor and pump unit, conventional in nature, may be controlled by a push button switch 46, mounted on the control panel of the dryer and electrically connected to the motor-pump unit, as shown by the dotted line therebetween.

A second reservoir 30', substantially similar to reservoir 30, also mounted to external housing 32 of clothes drying appliance 10' may be provided for dispensing desired additives and/or another electrically charged liquid. Reservoir 30' may be coupled to reservoir 30 and to either the valve control or the motor-pump unit 44 by means of a tee-joint 48, as shown in the drawing.

In a nonlimiting example of a use of the apparatus as shown in FIG. 1, a fabric article in need of treatment is placed in the fabric article receiving volume 13 of the clothes drying appliance 10. The drum 14 of the dryer is activated in the usual way. Immediately after tumbling begins, the operator simply depresses button 21 of valve 20 for a short period. Electrically charged liquid then flows from a reservoir (not shown) through liquid supply pipe 18 (from a reservoir), through valve 20, and is discharged from nozzle 16 onto the clothing within the drum 14. The electrically charged liquid is discharged from nozzle 16 in the form of a mist.

As described herein below, the present invention is configured such that the electrically charged liquid is uniformly applied to the fabric articles for refreshing the fabric articles. As used herein, the term mist means atomized droplets of liquid which may contain solid particles in solution with the liquid. Effective distribution of the electrically charged liquid is important to achieving the desired benefits and is enhanced by selecting a mist form of the electrically charged liquid in which the mean particle diameter size is optimally chosen. To that end, the mean particle diameter size of the electrically charged liquid mist can be from about 10 microns to about 1500 microns, and/or from about 60 microns to about 600 microns, and/or from about 100 microns to about 400 microns. Furthermore, the electrically charged liquid may have a mean particle diameter size that has a narrow particle size distribution to enhance even deposition on the fabric article.

For purposes of enhancing the effective distribution of the electrically charged liquid on the fabric articles, the misting of the electrically charged liquid can be achieved using any suitable spraying device such as a hydraulic nozzle, sonic nebulizer, high pressure fog nozzle or the like to deliver target particle sizes. However, the misting is preferably accomplished using a relatively low volume air atomization nozzle and/or a simple orifice. For example, spray nozzles commercially available from Spray Systems, Inc. (Model Nos. 850, 1050, 1250, 1450 and 1650) are suitable.

Referring to FIGS. 1 and 2, to achieve the misting of the electrically charged liquid within the fabric article receiving volume 13, a compressor may be provided. The compressor may be connected to an air supply tube which can supply air to the nozzle 16.

One non-limiting means of electrically charging the liquid is to charge the liquid in the reservoir. One means of doing this is to include a high voltage wire from the high voltage power in the reservoir.

Figure 4:
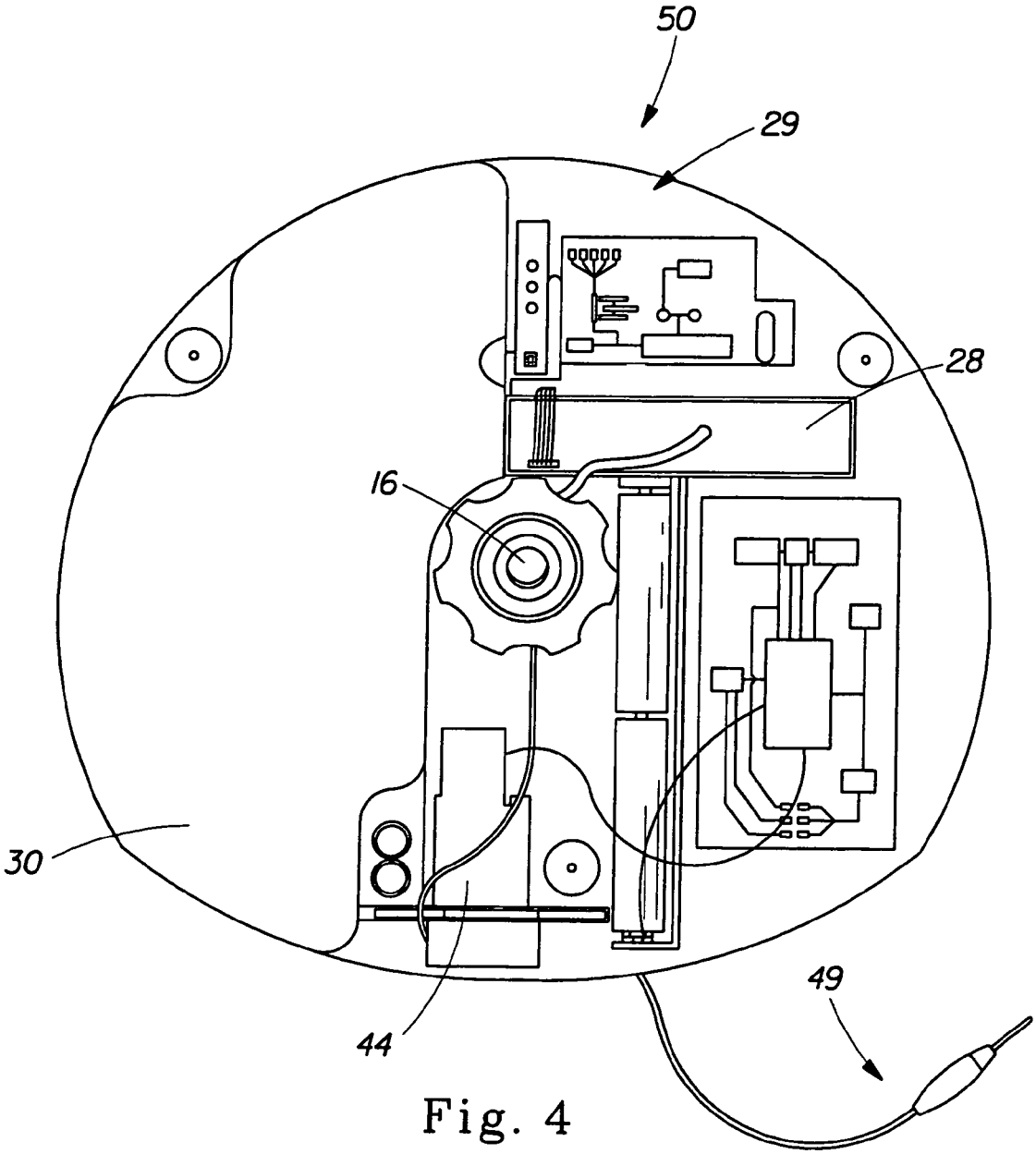
FIG. 4 is a top view showing the interior of a device made in accordance with the present invention.
Figure 5:
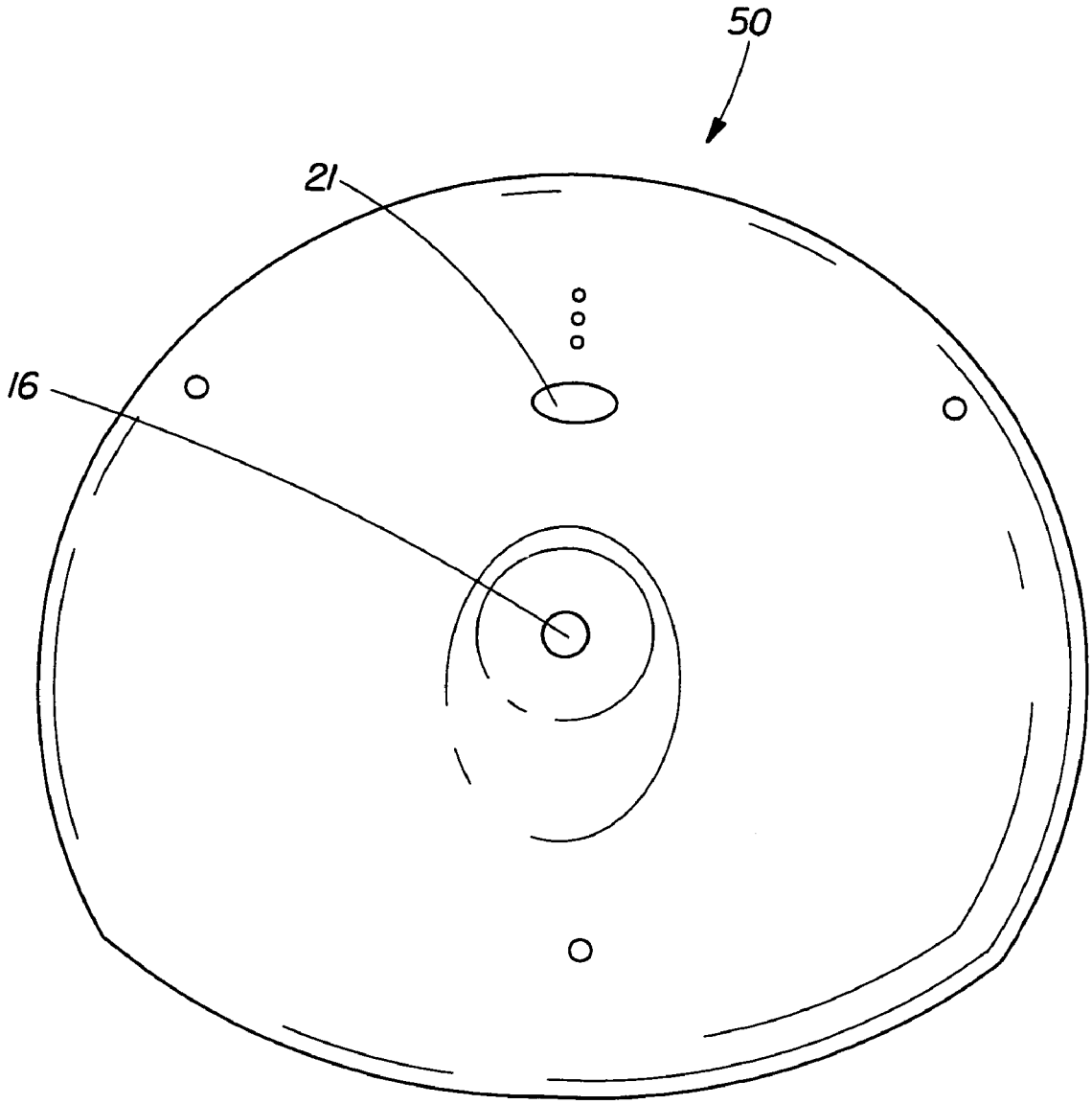
FIG. 5 is a top view showing the exterior of the device of FIG. 4.

In another embodiment of the present invention, shown in FIGS. 4 and 5, the source of the electrically charged liquid may be a self-contained stand-alone device 50. The device 50 may be fixedly attached or removably attached to the drying appliance. The device 50 is attached to the drying appliance in a manner such that the electrically charged liquid is able to contact the interior surface of the drying appliance and/or the fabric inside the drying appliance. One non-limiting example of a suitable location to attach the device 50 is to the inside of the drying appliance door. The source of electrically charged liquid comprises:

a. reservoir 30 for containing a liquid to be electrically charged;

b. a nozzle 16 in fluid communication with the reservoir 30, wherein the nozzle 16 has at least one orifice through which a liquid passes during delivery to the fabric article;

c. an electrical charging component 28 for electrically charging a liquid; and d. optionally, a means for grounding the device 50 for the purpose of charge dissipation, wherein the means for grounding comprises: i) a connector in electrical contact with the low level voltage output of the generator and which is maintained at low or zero electrical potential; and ii) a pin 49 or other fastening means in electrical contact with the fabric article and which is capable of being electrically isolated from the connector and from ground, and wherein in use, the connector and fastening means are brought into electrical connection in order to establish a charge-dissipation grounding loop.

Referring to FIG. 5, push button 21 could be used to activate the device 50.

The delivery of the electrically charged liquid from the source into the clothes drying appliance can be controlled automatically, manually controlled by the user, or a combination thereof. The delivery of the electrically charged liquid is influenced a number of variable, non-limiting examples of which include: orientation of the source of the electrically charged liquid in the clothes drying appliance, the charge/mass of the liquid droplets, the air or fabric article temperature in the clothes drying appliance, the relative air humidity in the clothes drying appliance, and/or water retention of the fabric article within the clothes drying appliance. One or more sensors 29, such as the non-limiting example illustrated in the embodiment of FIG. 4, can be used in conjunction with the source of the electrically charged liquid and/or the drying appliance to measure these variables.

Atomization in the method and apparatus of the present invention is achieved in one embodiment using electrostatic ligament atomization. The liquid is charged to high electrostatic voltage (at any place in the liquid supply system—it does not make a difference as to where since conductive liquids are used herein). The liquid is pumped through the liquid supply system and a simple orifice generates a hydrojet. The jet breaks into charged droplets because the liquid surface is electrically charged to an energy level above its liquid surface tension with the result that the liquid surface becomes unstable and break-up occurs. The charged droplets are pulled towards the garment that rests at a lower (higher) electrical potential for positively (negatively) charged droplets. Though the drum surface of the clothes drying appliance can be either grounded or ungrounded, one means of dissipating any excess charge from the garment is through a grounded drum surface.

Unwanted deposition of charged droplets on some interior surfaces of the drying appliance can be reduced by charging those particular surfaces with a higher (lower) electrical potential than the positively (negatively) charged droplets themselves. This technique enhances the deposition of droplets on the clothes or other grounded surfaces where deposition is desired.

Typical clothes drying appliances have airflows in excess of 200 cubic feet/minute (cfm). This airflow can be axial in design (back to front of drum) or counter-current (in and out the back of the drum). Due to these high airflows, turbulent conditions, and varying dryer designs, careful attention must be paid to droplet size, velocity, and direction coming out of the spray nozzle. The goal of optimizing size, velocity and direction are to reduce product losses out the dryer vent to under 50%.

Depending on the size of droplets dispensed via the nozzle, the velocity of the particles can be adjusted so that the average droplet size reaches 0 m/sec axial velocity at a point between ⅛ and ⅞ of the distance to the back of the dryer drum. This minimizes loss of droplets out either a front or back vent as well as buildup of liquid on the front and back walls of the drum.

Alternatively, the droplet direction can be angled so that the spray pattern is directed to the sides of the drum or at the clothes rather than to the opposite wall of the dryer. This approach is generally used for lower flow rates (i.e.; less than 100 ml/minute) provided the droplets impact the clothes or dryer wall before the droplets are caught up in the airflow of the dryer and removed via the venting system. Higher flow rates (i.e.; greater than 100 ml/minute) tend to deposit efficiently on clothes but may cause a non-uniform deposition pattern giving the appearance of smears, streaks or wet-strikes.

The time for applying the electrically charged liquid may be between about 0.1 minutes to 120 minutes depending on the choice of cycle and the load size. While the electrically charged liquid is being supplied into the fabric article receiving volume 13, a fan can be energized to circulate air within the fabric article receiving volume 13. Optionally, a heater may be periodically energized for supplying heat to the fabric article receiving volume 13, especially during the treatment period.

The temperature of air during the treatment period is in the range from about 30° C. to about 80° C., more preferably from about 40° C. to about 65° C. The treatment time period may be from about 10 to 180 minutes long, depending on the cycle selected and load size. Referring to FIGS. 1 and 2, an exhaust air duct may be provided in the clothes drying appliance 10 for allowing air to be exhausted from the fabric article receiving volume 13 during the treatment period. The exhaust duct may be connected with duct work such that the exhaust air is vented out of the user's home as is the case in conventional dryer applications. The duct may be provided with a closing means such that the duct can be closed during the electrically charged liquid application step.

The particular electrically charged liquid selected for use in the process can vary widely depending upon the particular benefit desired. However, in preferable modes of operation, the electrically charged liquid will contain ingredients which can be effective across a variety of fabric article types. For example, the electrically charged liquid will preferably be suitable for "dry-clean" only fabric articles as well as pure cotton dress shirts which typically require a significant dewrinkling operation subsequent to conventional laundering operations (i.e. home washings and drying cycles).

Volume Refreshment Rate

The Volume Refreshment Rate is defined as the frequency that the total volume of air within the interior void space of a container is replaced, expressed in units of seconds$^{-1}$. If an apparatus such as a the fabric article treating system of the present invention vents substantially less than 0.0004 $s^{-1}$ then venting may become too weak, and performance may deteriorate unless the cycle length is substantially increased. Without wishing to be bound by theory, one volume refreshment per cycle may be enough to provide good performance.

The Volume Refreshment Rate for the apparatus of the present invention can be from about 0.0004 $s^{-1}$ to about 1.0 $s^{-1}$ and preferably from about 0.01 $s^{-1}$ to about 0.5 $s^{-1}$.

It can be seen by the above description that the present invention provides a unique fabric article treating method and fabric article treating system which effectively treats fabric articles by applying an electrically charged liquid onto the fabric articles.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention. All documents cited in the Detailed Description of the Invention are, in relevant part, incorporated herein by reference. The citation of any document is not to be construed as an admission that it is prior art with respect to the present invention.

What is claimed:

1. An in-home method for treating a fabric article in need of treatment compnsing:

a. providing a fabric article treating system designed for domestic use, wherein the system comprises 1) a clothes drying appliance, and 2) a source of an electrically charged liquid, and optionally, 3) a safety system capable of preventing contact of the electrically charged liquid to a user of the fabric article treating system;

b. placing the fabric article in need of treatment within the clothes drying appliance;

c. operating the fabric article treating system such that the source of the electrically charged liquid delivers an electrically charged liquid having an applied potential in the range of from about 0.2 to about 50 kV to the fabric article placed within the clothes drying appliance such that the fabric article is treated.

2. The method according to claim 1 wherein the source of the electrically charged liquid is located inside of the clothes drying appliance.

3. The method according to claim 1 wherein the electrically charged liquid comprises water.

4. The method according to claim 3 wherein the electrically charged liquid further comprises a non-volatile mineral agent.

5. The method according to claim 3 wherein the electrically charged liquid further comprises one or more fabric article actives selected from the group consisting of: solvents, surfactants, wrinkle releasing agents, anti-static agents, anti-shrinking agents, antibacterial agents, wetting agents, crystal modifiers, soil release agents, colorants, brighteners, perfume, odor reducers/eliminators, deodorizer/refreshing agents, stain repellents, color enhancers, starch, sizing agents, and mixtures thereof.

6. The method according to claim 1 wherein the method further comprises the step of:

d. drying the treated fabric article.

7. The method according to claim 1 wherein the fabric article is treated with the electrically charged liquid while the fabric article is in motion within the clothes drying appliance.

8. The method according to claim 1 wherein the source of an electrically charged liquid comprises a liquid reservoir and/or a nozzle for delivering the electrically charged liquid.

* * * * *